US007319200B2

(12) United States Patent
Chou

(10) Patent No.: US 7,319,200 B2
(45) Date of Patent: Jan. 15, 2008

(54) JERKING-INITIATED SWITCH

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 76 days.

(21) Appl. No.: 11/446,466

(22) Filed: Jun. 2, 2006

(65) Prior Publication Data

US 2007/0278070 A1 Dec. 6, 2007

(51) Int. Cl.
*H01H 35/14* (2006.01)

(52) U.S. Cl. ..... 200/61.45 R; 200/61.51; 200/61.52

(58) Field of Classification Search ..... 200/61.45 R–61.45 M; 73/514.01, 514.16, 514.29, 73/514.35

See application file for complete search history.

(56) References Cited

U.S. PATENT DOCUMENTS 4,751,353 A * 6/1988 Stephens ..... 200/61.52
4,766,275 A * 8/1988 Hemmann et al. ..... 200/61.52
5,602,429 A * 2/1997 Scgiebelhuth ..... 200/61.52
5,808,254 A * 9/1998 Wu ..... 200/61.45 R
6,028,275 A * 2/2000 Jou ..... 200/61.52
6,448,516 B1 * 9/2002 Chiang ..... 200/61.45 R
6,518,523 B1 * 2/2003 Chou ..... 200/61.52
6,559,396 B1 * 5/2003 Chou ..... 200/61.52
6,706,978 B2 * 3/2004 Wagatsuma et al. .. 200/61.45 R
7,045,724 B1 * 5/2006 Chou ..... 200/61.45 R
7,176,396 B1 * 2/2007 Chou ..... 200/61.52
7,256,360 B1 * 8/2007 Chou ..... 200/61.45 R

* cited by examiner

*Primary Examiner*—Michael A Friedhofer
(74) *Attorney, Agent, or Firm*—Frommer Lawrence & Haug LLP; Ronald R. Santucci

(57) ABSTRACT

A jerking-initiated switch includes first and third shank members secured to an insulating frame and spaced apart from each other, and at least one second shank member interposed therebetween. Each of the shank members has a contact terminal extending outwardly of the frame to electrically contact a substrate. Two limb members are integrally formed and are connected to the second shank member, and extend towards the first and third shank members, respectively, so as to form guideways that an electrically conductive ball is rollable thereon. Each guideway has idle and threshold regions at different heights such that the ball is caused to displace from one of the idle and threshold regions to the other of the idle and threshold regions in response to a jerking action, thereby placing the switch in one of the first and second switching states.

11 Claims, 18 Drawing Sheets

JERKING-INITIATED SWITCH

BACKGROUND OF THE INVENTION

1. Field of the Invention

This invention relates to a jerking-initiated switch, more particularly to a jerking-initiated switch having an electrically conductive ball rollable within an insulating frame to engage or disengage from two spaced apart electric contact terminals.

2. Description of the Related Art

Referring to FIGS. 1 and 2, a conventional jerking-initiated switch 100 is shown to include an insulating housing 101, an electrically conductive ball 102, four contact terminals 103, and a plug 104. In assembly, the ball 102 is received in the housing 101, and an access opening of the housing 101 is closed by the plug 104. Tapered contact ends 1031 of the contact terminals 103 are inserted into the housing 101 through four through holes 1041 in the plug 104 by using a tool (not shown). By contacting the ball 102 with the contact ends 1031 of two of the terminals 103, the electric contact between the terminals 103 can be established. However, since the terminals 103 are mounted on the plug 104 and are disposed in a suspended state, the operation of the tool for assembling the terminals 103 must be precise so as to align the contact ends 1031 with one another. Moreover, as the terminals 103 are not firmly secured in the plug 104, sensitivity of the switch 100 is unsteady.

The switch 100 can be mounted on a substrate 105 in an upright state shown in FIG. 2. The switch 100 can also be mounted under the substrate 105 by bending the terminals 103 such that an included angle (θ) is formed between the housing 101 and the substrate 105. The angle (θ) is liable to be changed by an external force to result in failure of the switch 100.

SUMMARY OF THE INVENTION

The object of the present invention is to provide a jerking-initiated switch which has contact terminals mounted in a steady manner, and which can achieve enhanced sensitivity.

According to this invention, the jerking-initiated switch includes an insulating frame which has a base wall and first and second upright walls extending respectively from first and second lateral sides of the base wall to define a rolling path. An electrically conductive ball is disposed to be rollable along the rolling path between first and second switching positions where the switch is in first and second switching states, respectively. An interconnecting member is disposed adjacent to the first lateral side, and extends to terminate at front and rear joining ends. Front and rear first shank members, which are made from an electrically conductive material, are respectively connected to the front and rear first joining ends, and extend to respectively terminate at front and rear first contact terminals that extend outwardly of the frame to electrically contact a substrate. At least one second shank member, which is made from an electrically conductive material, is secured to the base wall. The second shank member extends to terminate at a second contact terminal that extends outwardly of the frame to electrically contact the substrate, and at a second joint that is opposite to the second contact terminal. At least one limb member is integrally formed with and extends from the second joint to form a guideway along the rolling path such that the ball can slidably contact the limb member. The limb member extends towards the front and rear first shank members to terminate at a threshold region. The threshold region is spaced apart from the front and rear first shank members, and corresponds to the first switching position. The limb member has an idle region which is configured to correspond to the second switching position such that once the ball is caused to displace from one of the idle and threshold regions to the other of the idle and threshold regions in response to a jerking action, the switch is placed in one of the first and second switching states.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
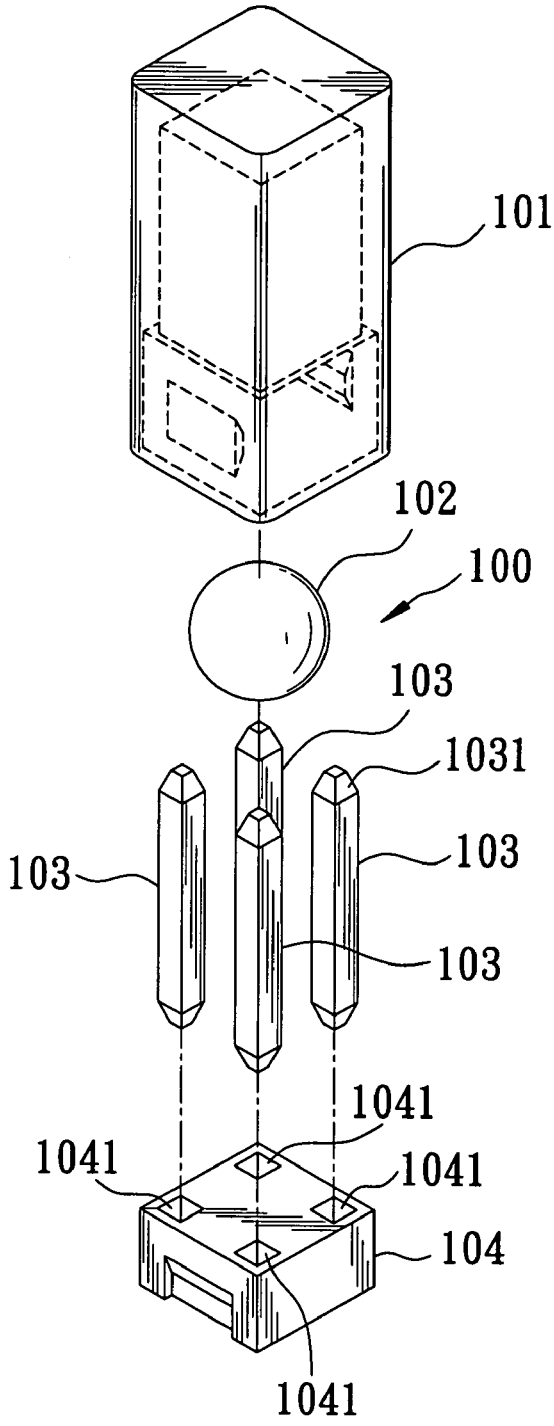
FIG. 1 PRIOR ART
FIG. 1 is an exploded perspective view of a conventional jerking-initiated switch.
Figure 2:
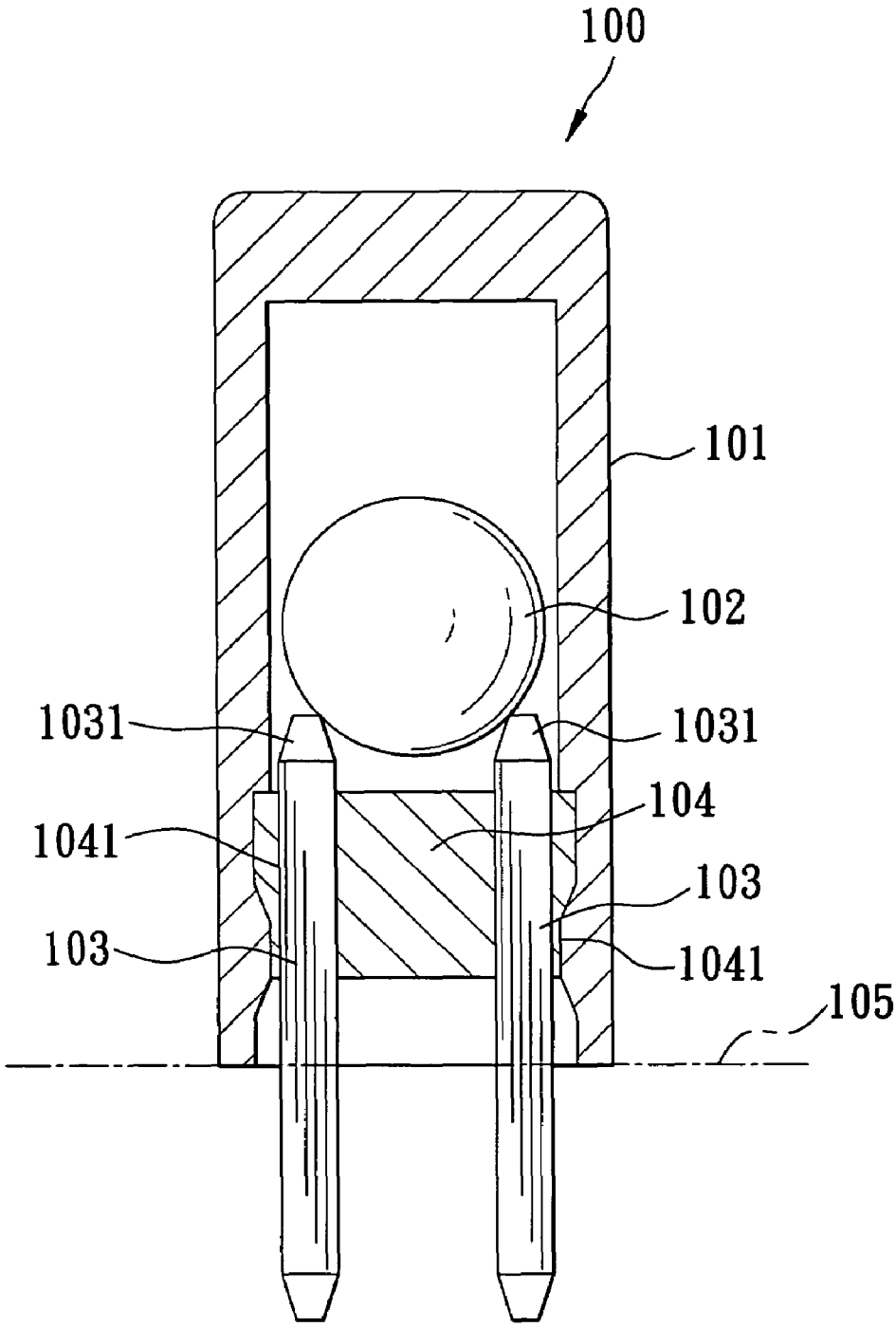
FIG. 2 PRIOR ART
FIG. 2 is a sectional view of the conventional jerking-initiated switch mounted on a substrate.
Figure 3:
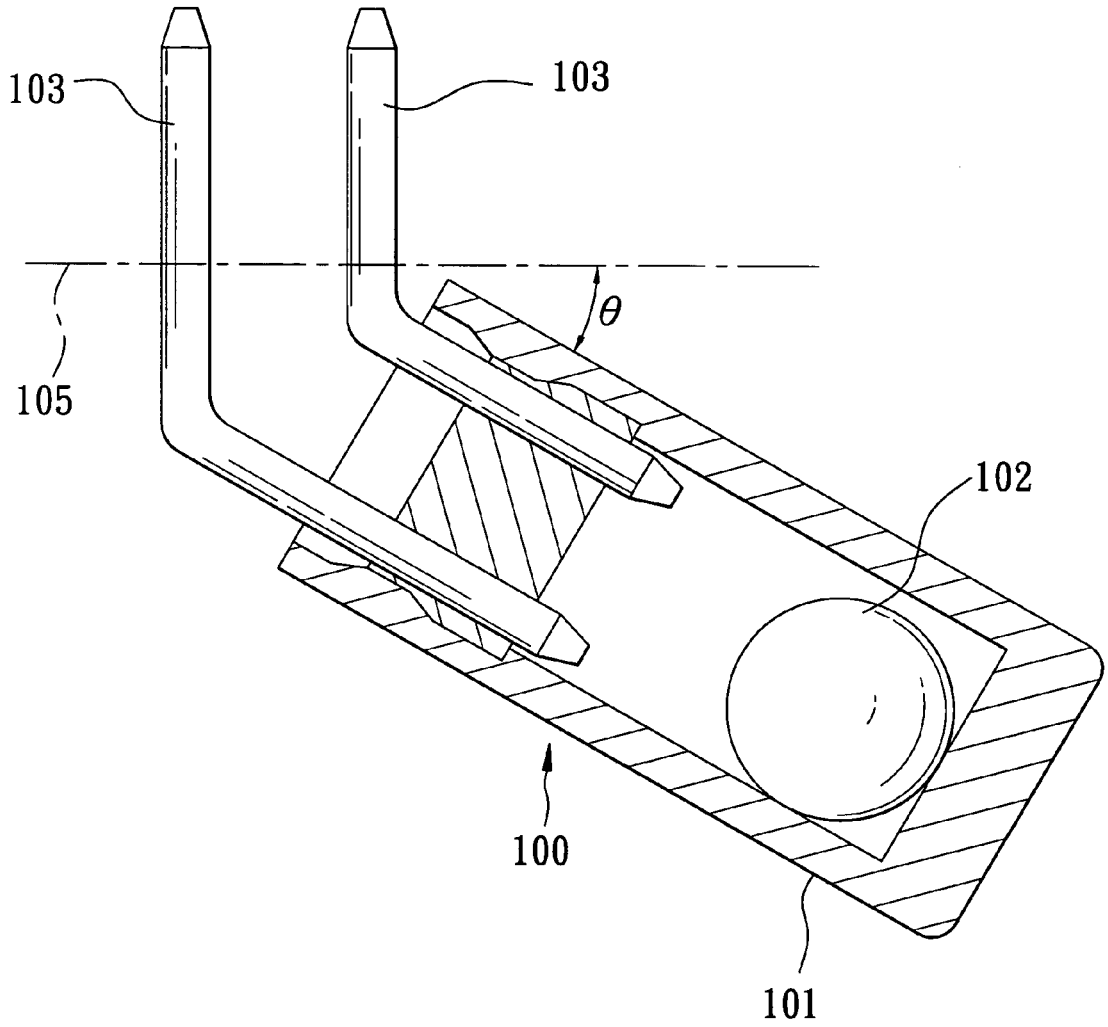
FIG. 3 PRIOR ART
FIG. 3 is a sectional view of the conventional jerking-initiated switch mounted under a substrate.

Before the present invention is described in greater detail, it should be noted that same reference numerals have been used to denote like elements throughout the specification.

Figure 4:
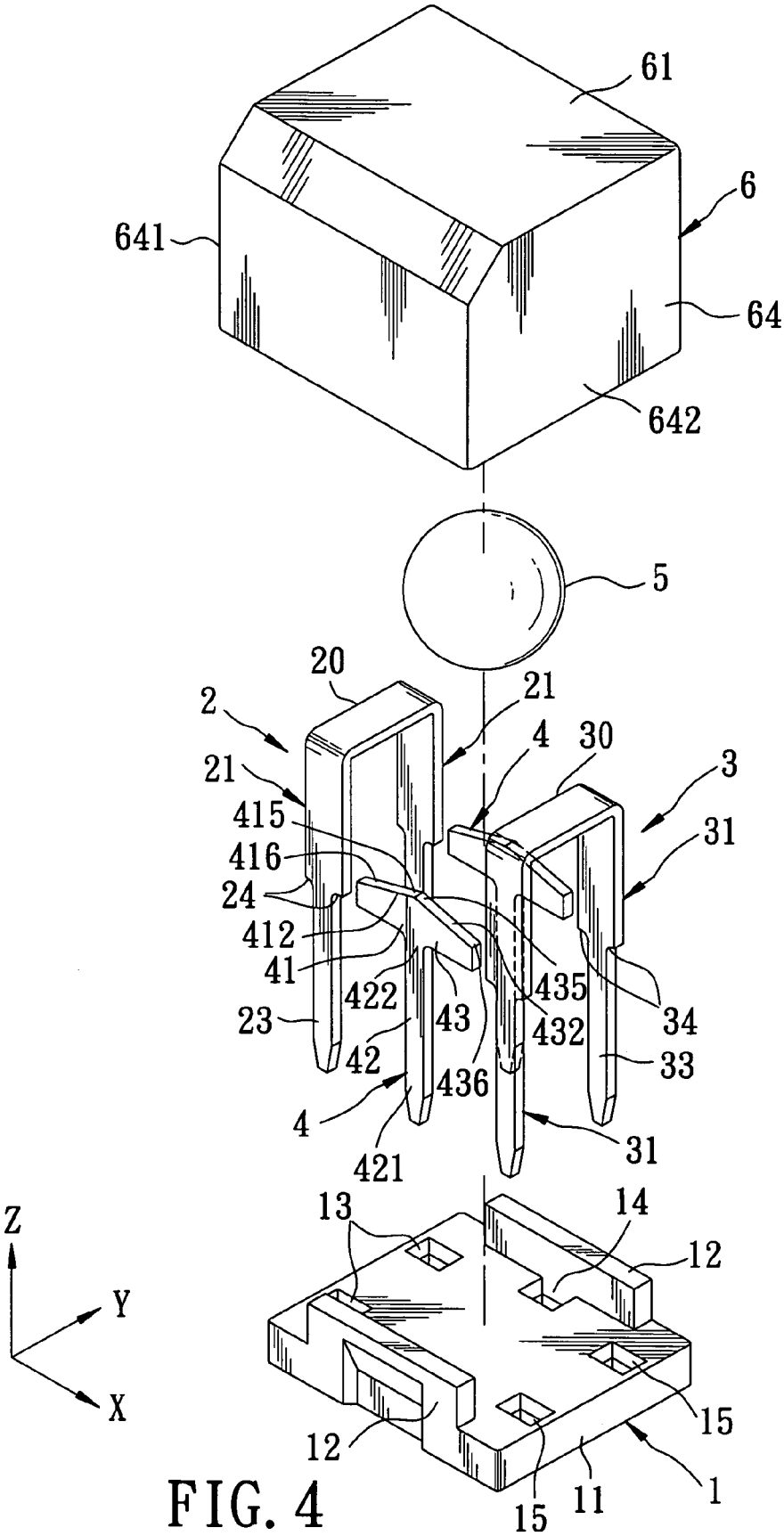
FIG. 4 is an exploded perspective view of the first preferred embodiment of a jerking-initiated switch according to this invention.
Figure 5:
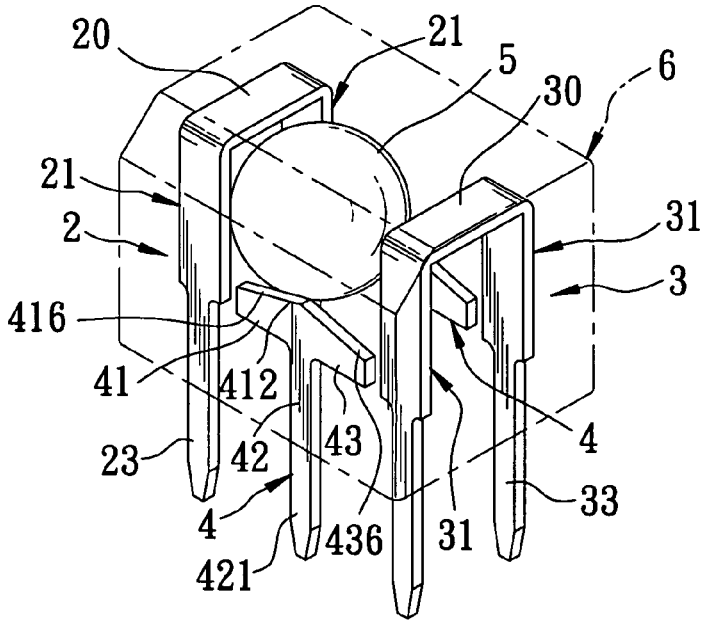
FIG. 5 is a schematic perspective view of the first preferred embodiment in a rest state.
Figure 6:
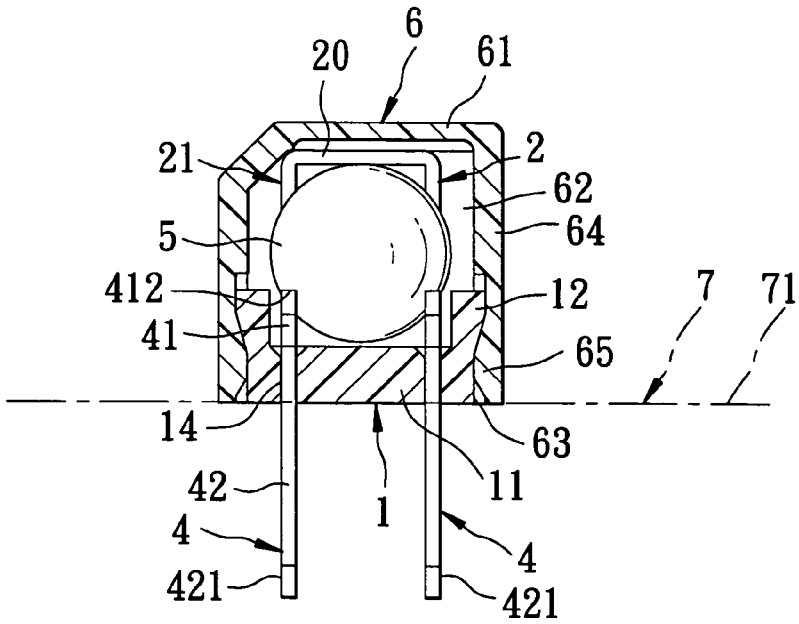
FIG. 6 is a cross-sectional view of the first preferred embodiment in the rest state of FIG. 5.

Referring to FIGS. 4 to 6, the first preferred embodiment of a jerking-initiated switch according to the present invention is shown to comprise an insulating frame 1, an electrically conductive ball 5, and a first terminal unit 2, a pair of second terminal units 4, and a third terminal unit 3.

The frame 1 includes a base wall 11 and a cover 6. The base wall 11 has first and second lateral sides opposite to each other in a longitudinal direction (X), and front and rear sides opposite to each other in a first transverse direction (Y) transverse to the longitudinal direction (X). The base wall 11 has a pair of projecting blocks 12 disposed on the front and rear sides, and a pair of first through holes 13, a pair of second through holes 14, and a pair of third through holes 15 extending therethrough in a second transverse direction (Z) transverse to both the first transverse direction (Y) and the longitudinal direction (X) and disposed in the first lateral side, a middle region, and the second lateral side, respectively. The cover 6 has a base 61 and a surrounding wall 64 extending from a periphery of the base 61 to terminate at an opening 63 to receive the base wall 11. The surrounding wall 64 includes first and second upright walls 641,642 extending in the second transverse direction (Z) to be connected to the first and second lateral sides, respectively. The cover 6 further has two projecting blocks 65 which are disposed to interengage the projecting blocks 12 so as to firmly secure the cover 6 to the base wall 11, as shown in FIG. 6. Thus, an accommodation space 62 is confined between the base wall 11 and the cover 6, and defines a rolling path therein.

The ball 5 is received in the accommodation space 62 to be rollable along the rolling path between first and second switching positions where the jerking-initiated switch is in first and second switching states, respectively (to be described in greater detail in the succeeding paragraphs).

The first and third terminal units 2,3 have the same construction and are made from an electrically conductive metal plate, such as a copper plate. Each of the first and third terminal units 2,3 includes a first (second) interconnecting member 20 (30), and front and rear first (third) shank members 21 (31). The first (second) interconnecting member 20 (30) extends in the first transverse direction (Y) to terminate at front and rear first (second) joining ends. The front and rear first (third) shank members 21 (31) are connected to the front and rear first (second) joining ends, respectively, and extend in the second transverse direction (Z) to terminate at front and rear first (third) contact terminals 23 (33), respectively. The front and rear first (third) contact terminals 23 (33) extend respectively through the first (three) through holes 13 (15) to be disposed outwardly of the base wall 11 so as to electrically contact a substrate 7. Each of the first (third) shank members 21 has a shoulder portion 24 (34) that abuts against the base wall 11 when the respective contact terminal 23 (33) is extended through the respective through hole 13 (15) so as to secure the first (third) terminal unit 2 (3) to the frame 1.

Each of the second terminal units 4 has a single-piece construction, and is made from an electrically conductive material, and includes a second shank member 42, a first limb member 41, and a second limb member 43. The second shank member 42 extends in the second transverse direction (Z) to terminate at a second contact terminal 421 that extends through the respective second through hole 14 to be disposed outwardly of the base wall 11 so as to electrically contact the substrate 7, and at a second joint 422 that is opposite to the second contact terminal 421. The first and second limb members 41,43 have the same configuration, and extend from the second joint 422 in the longitudinal direction (X) and away from each other to form respectively first and second guideways 412,432 along the rolling path such that the ball 5 can slidably contact the first and second limb members 41,43. The first and second limb members 41,43 extend respectively towards the first and third shank members 21,31 to terminate at first and second threshold regions 416,436, respectively. The first and second threshold regions 416,436 are spaced apart from the first and third shank members 21,31, respectively, and correspond to the first switching position. The first and second limb members 41,43 have first and second idle regions 415,435, respectively, which are configured to correspond to the second switching position.

In this embodiment, each of the guideways 412,432 is configured to descend from the respective idle region 415, 435 to the respective threshold region 416,436 in the longitudinal direction (X). Therefore, as shown in FIGS. 5 and 6, when the switch of this embodiment is mounted uprightly on an upper surface 71 of the substrate 7, the ball 4 rests on one of the threshold regions 416,436 (the first threshold region 416 in FIG. 5) to place the switch in the first switching state, where the second contact terminals 421 are electrically connected to one of the first and third contact terminals 23,33 (the first contact terminals 23 in FIG. 5) through the ball 5.

Figure 7:
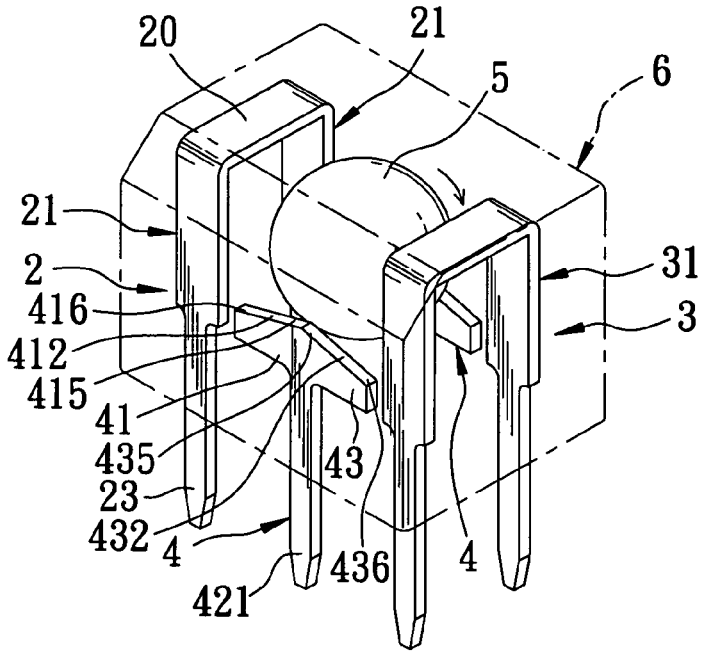
FIG. 7 is a view similar to FIG. 5 but showing the first preferred embodiment in a jerked state.
Figure 8:
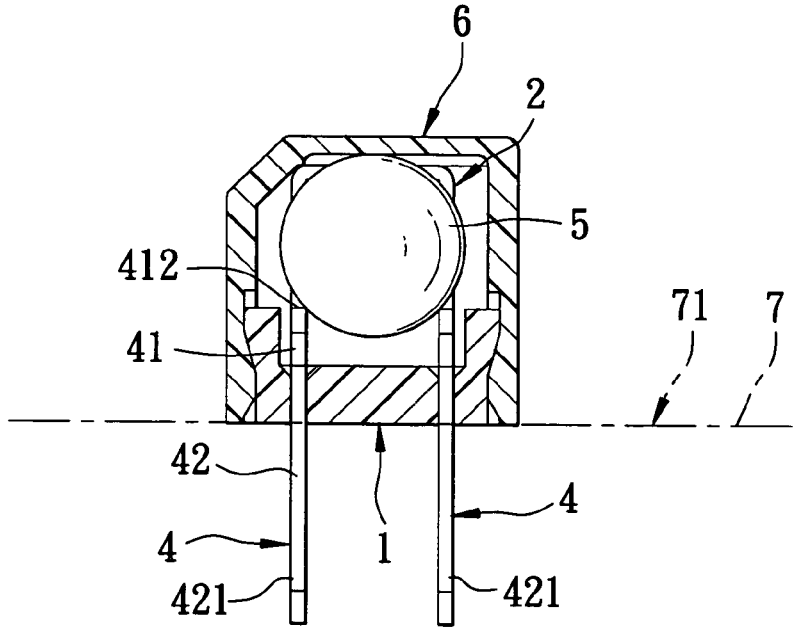
FIG. 8 is a view similar to FIG. 6 but showing the first preferred embodiment in the jerked state of FIG. 7.

As shown in FIGS. 7 and 8, a jerking action will cause the switch to tilt and the ball 4 to displace from the threshold region 416 to the idle region 415 or 435 without contacting the first terminal unit 2 so as to place the switch in the second switching state, where the electric connection between the first and second contact terminals 23,421 is cut-off.

Figure 9:
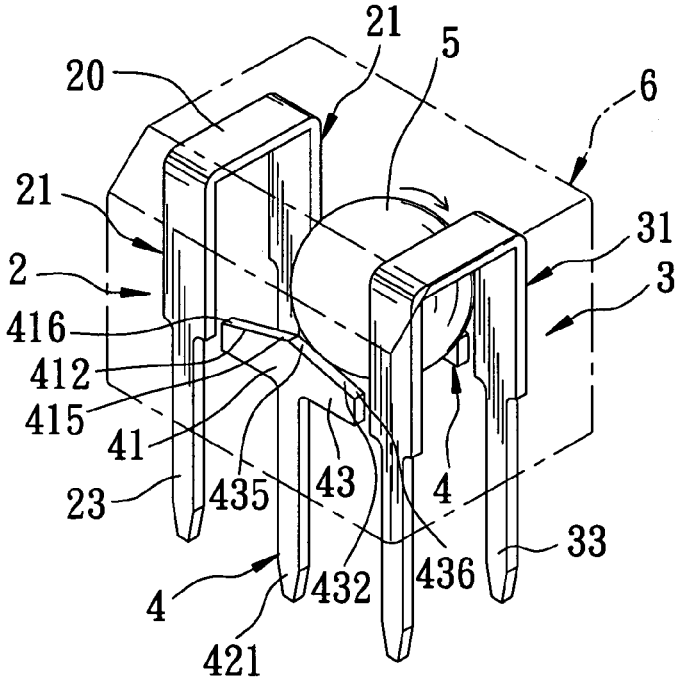
FIG. 9 is a view similar to FIG. 5 but showing the first preferred embodiment in another rest state.
Figure 10:
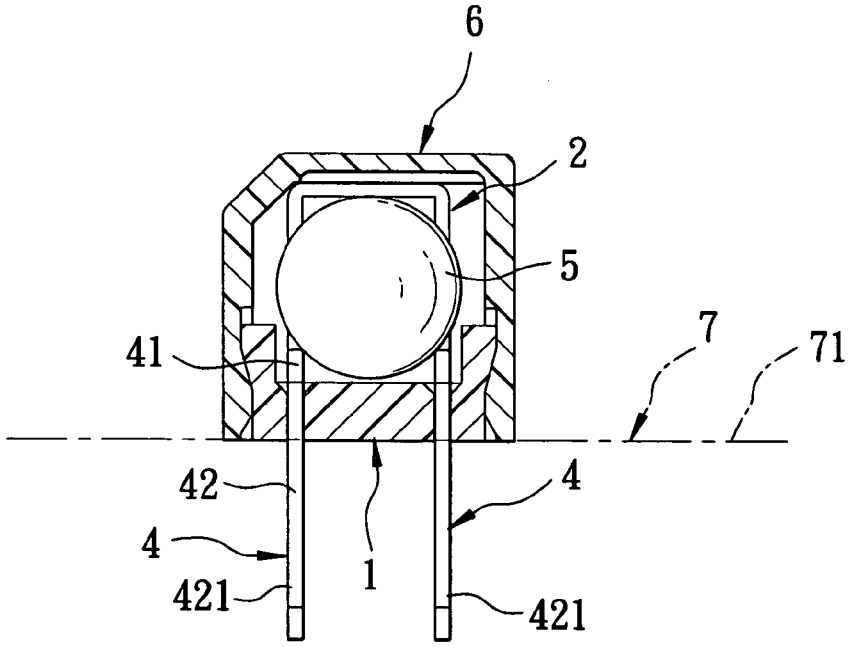
FIG. 10 is a view similar to FIG. 6 but showing the first preferred embodiment in the rest state of FIG. 9.

Thereafter, as shown in FIGS. 9 and 10, once the ball 4 rolls over the idle regions 415,435 and to the other one of the limb members 41,43 (the second limb member 43 in FIG. 9) to rest in the corresponding threshold region 436, the switch is placed in the first switching state, where the second contact terminals 421 are electrically connected to the other one of the first and third contact terminals 23,33 (the third contact terminals 23 in FIG. 9) through the ball 5.

As illustrated, in comparison with the conventional switch 100, the first, second and third terminal units 2,4,3 in this invention are fitted into the frame 1 individually, and are retained therein by virtue of the engagement between the base wall 11 and the cover 6. Thus, the problem associated with alignment of the terminals 103 in the housing 101 of the conventional switch 100 can be overcome, and the terminal units 2,4,3 can be retained on the frame 1 steadily and firmly. In addition, since the limb members 41,43 are of a plate shape, the area of contact between the limb members 41,43 and the ball 4 is increased to result in enhanced electric contact and improved sensitivity.

Figure 11:
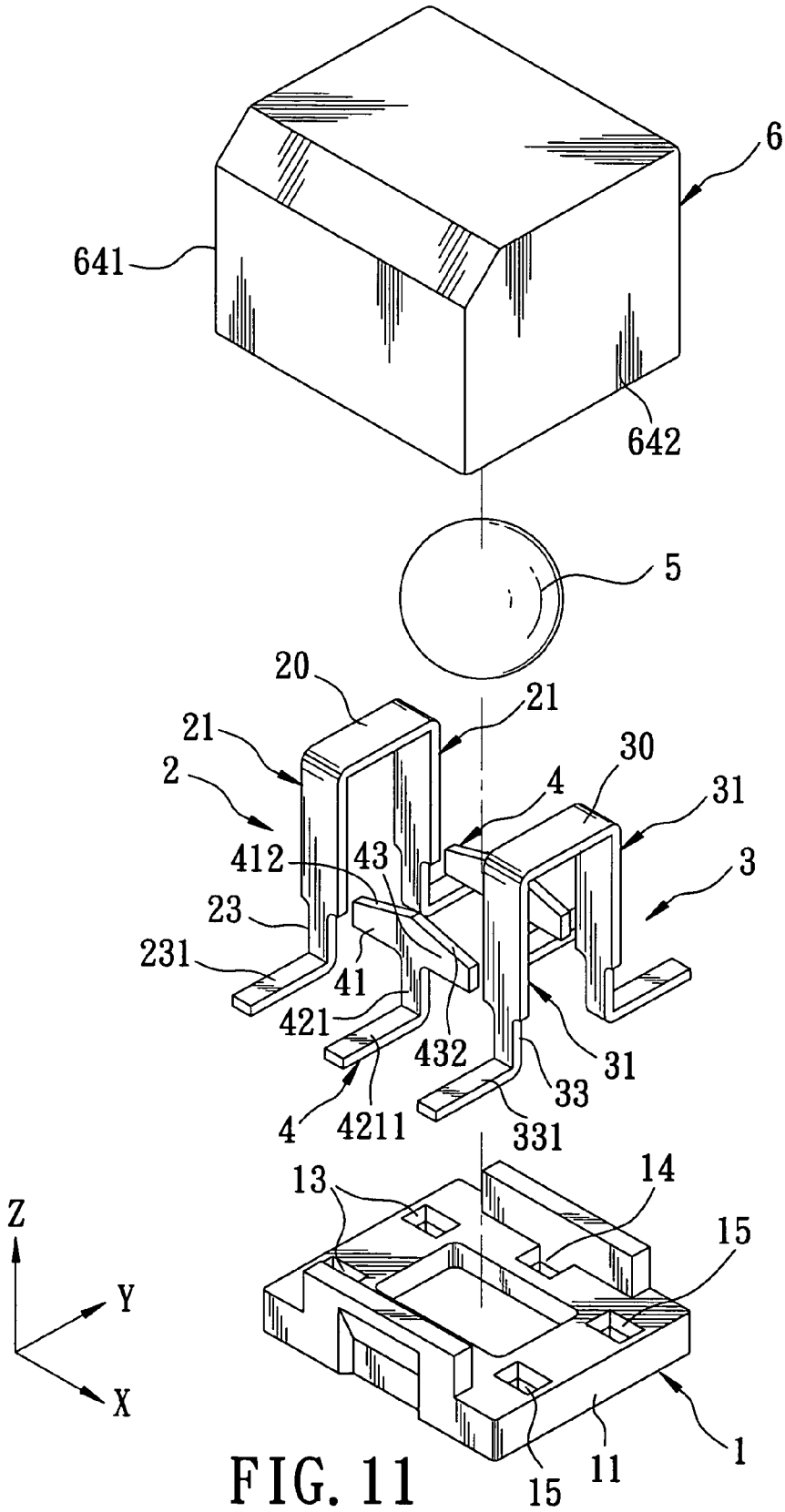
FIG. 11 is an exploded perspective view of the second preferred embodiment of a jerking-initiated switch according to this invention.

Referring to FIG. 11, the second preferred embodiment of a jerking-initiated switch according to this invention is shown to be similar to the first embodiment in construction. In the second embodiment, each of the first, second and third contact terminals 23,421,33 has a contact end 231,4211,331 which is bent to extend in the first transverse direction (Y) and which has a major surface that is adapted to be attached to the substrate 7 using a conventional SMT (surface mount technology) process.

Figure 12:
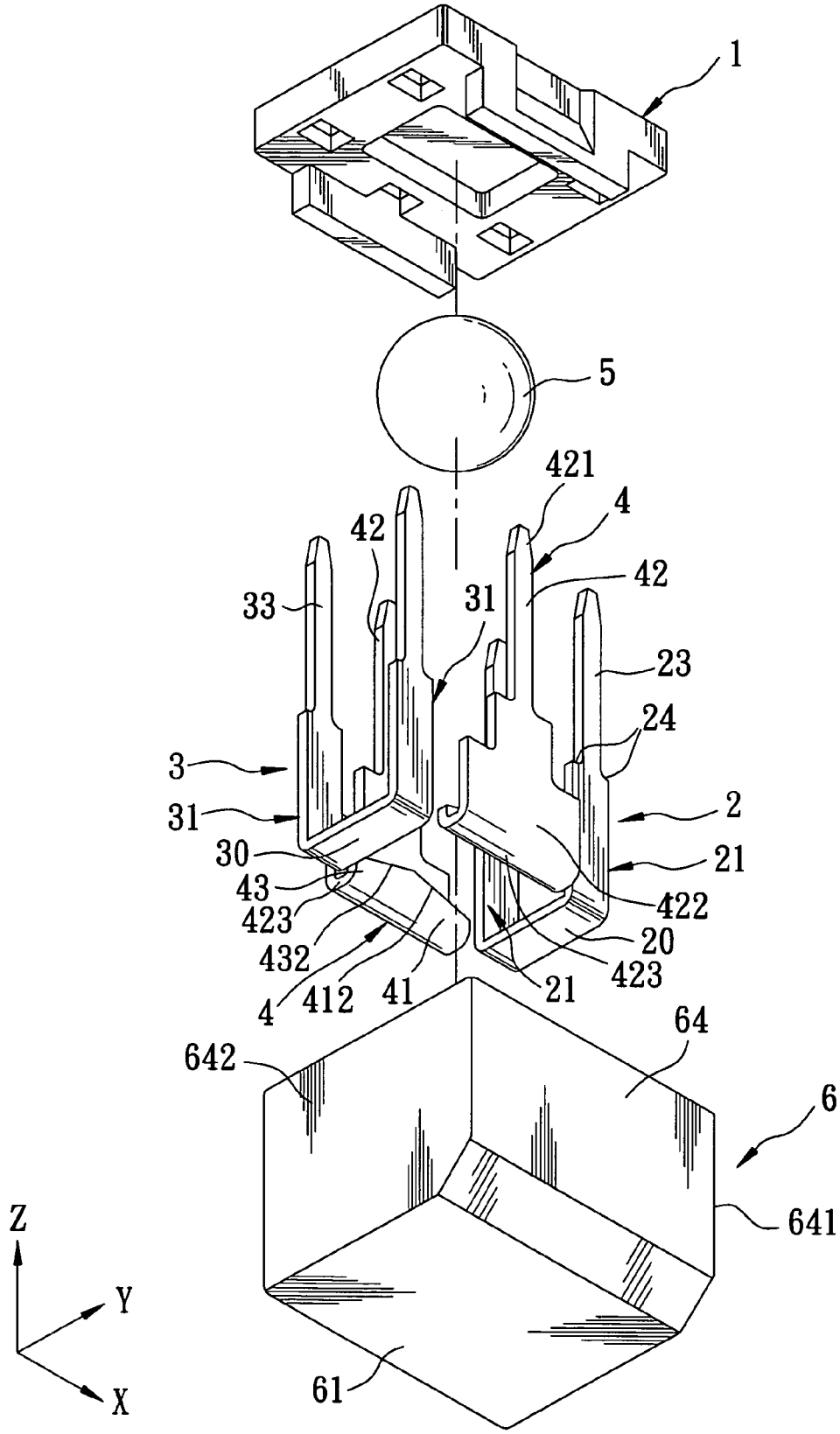
FIG. 12 is an exploded perspective view of the third preferred embodiment of a jerking-initiated switch according to this invention.
Figure 13:
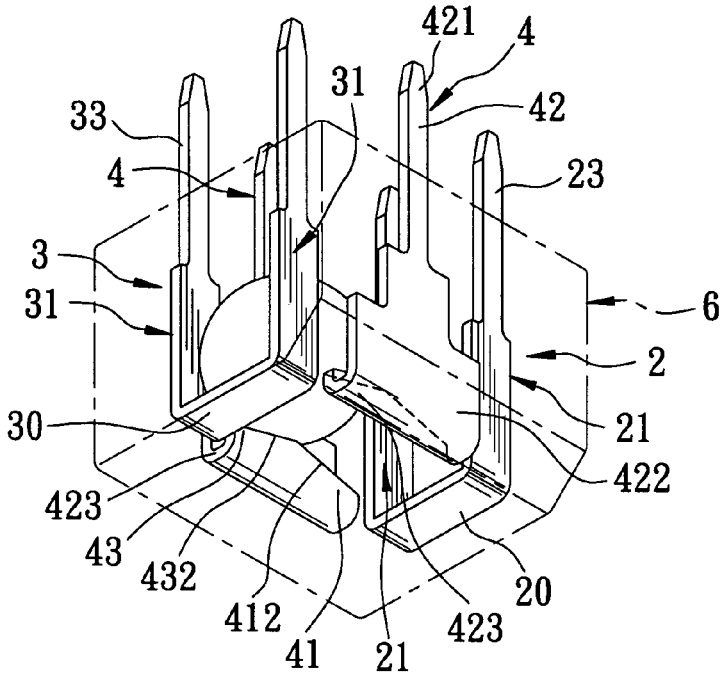
FIG. 13 is a schematic perspective view of the third preferred embodiment in a rest state.
Figure 14:
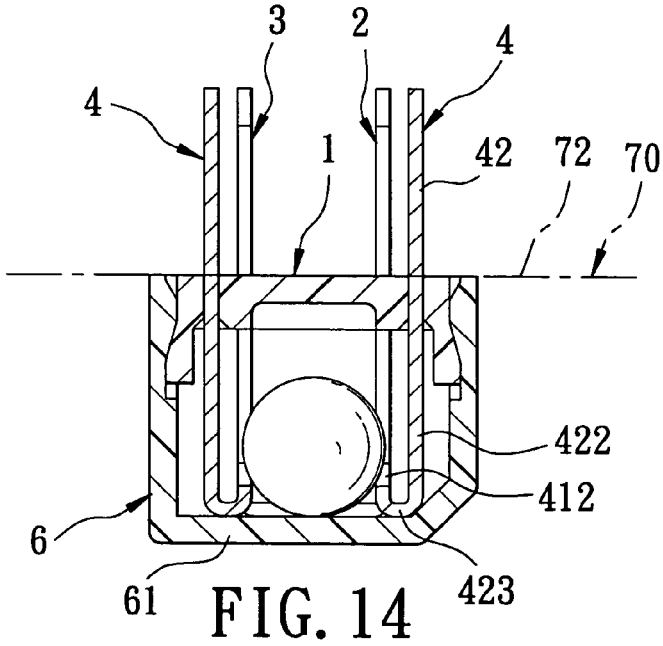
FIG. 14 is a cross-sectional view of the third preferred embodiment in the rest state of FIG. 13.

Referring to FIGS. 12 to 14, the third preferred embodiment of a jerking-initiated switch according to this invention is shown to be similar to the first embodiment in construction. In the third embodiment, the switch is adapted to be mounted on a lower surface 72 of a substrate 70. Specifically, the second joint 422 of each second shank member 42 has a bent connecting portion 423 which is bent to extend in the first transverse direction (Y) such that the respective first and second limb members 41,43 extend from the bent connecting portion 423 in the second transverse direction (Z).

Figure 15:
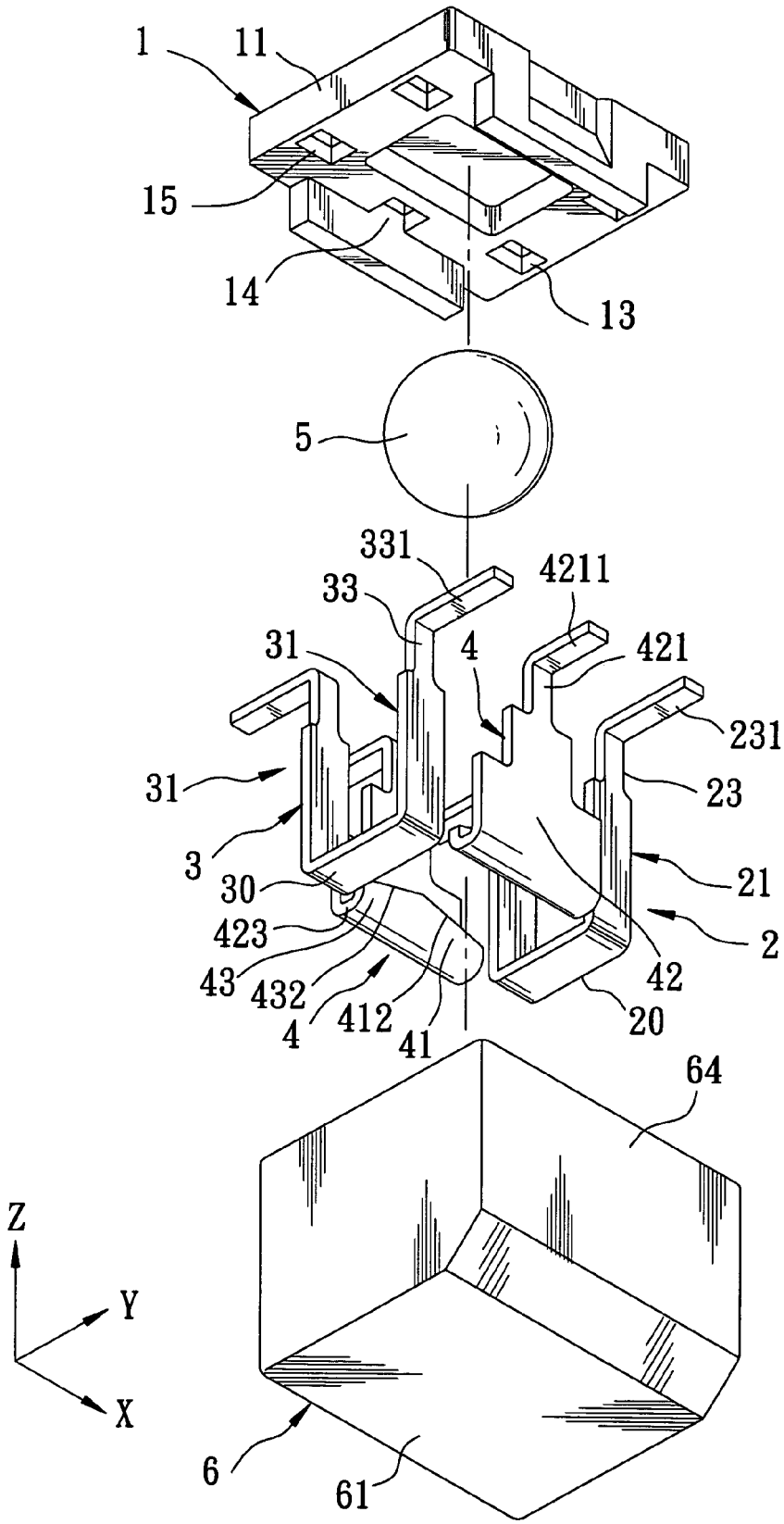
FIG. 15 is an exploded perspective view of the fourth preferred embodiment of a jerking-initiated switch according to this invention.
Figure 16:
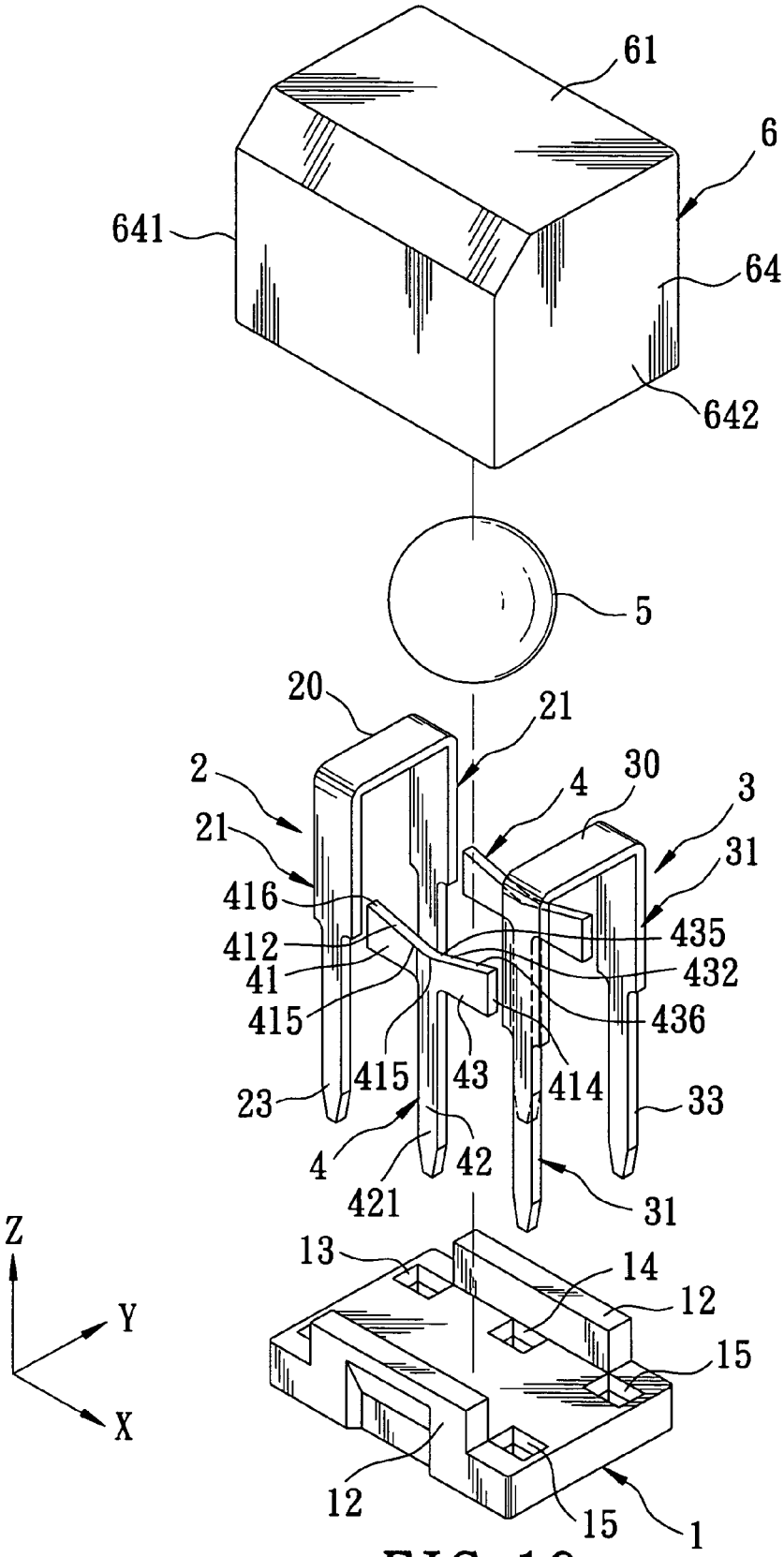
FIG. 16 is an exploded perspective view of the fifth preferred embodiment of a jerking-initiated switch according to this invention.

Referring to FIG. 15, the fourth preferred embodiment of a jerking-initiated switch according to this invention is shown to be similar to the third embodiment in construction. In the fourth embodiment, each of the first, second and third contact terminals 23,421,33 has a contact end 231,4211,331 which is bent to extend in the first transverse direction (Y) and which has a major surface that is adapted to be attached to the substrate (not shown) using a conventional SMT process.

Figure 17:
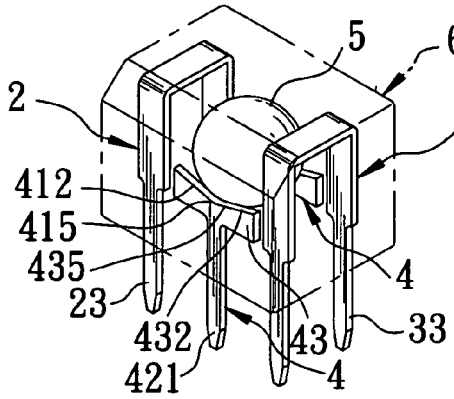
FIGS. 17 to 19 are respective schematic perspective views of the fifth preferred embodiment in different states.
Figure 18:
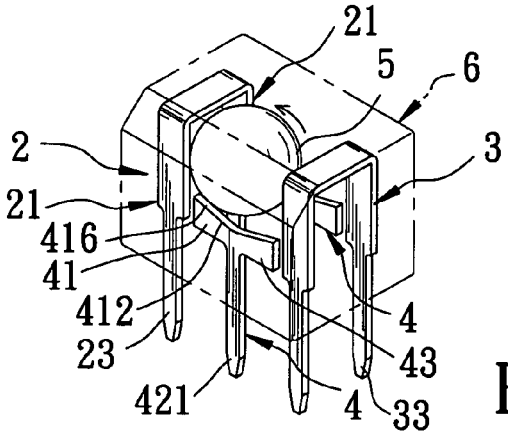
Figure 19:
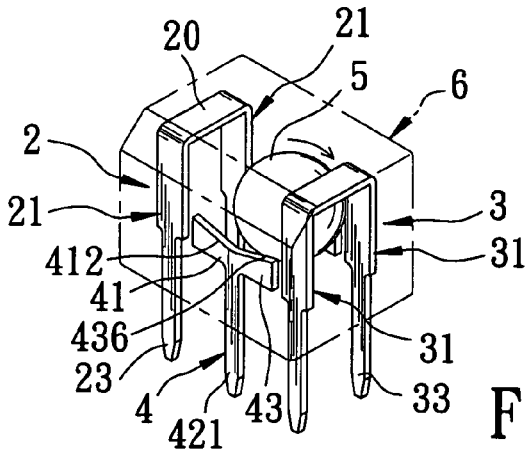

Referring to FIGS. 16 to 19, the fifth preferred embodiment of a jerking-initiated switch according to this invention is shown to be similar to the first embodiment in construction. In the fifth embodiment, each of the first and second guideways 412,432 is configured to ascend from the respective idle region 415,435 to the respective threshold regions 416,436 in the longitudinal direction (X) such that each pair of the first and second guideways 412,432 is V-shaped. Thus, the ball 5 is rested on the first or second idle region 415,435 to place the switch in the second switching state, as shown in FIG. 17, where the first and third contact terminals 23,33 are not electrically connected to the second contact terminals 421. Once a jerking action causes the ball 5 to roll from the first or second idle region 415,435 to one of the first and second threshold regions 416,436 (the first threshold region 416 in FIG. 18 or the second threshold region 436 in FIG. 19), the switch is placed in the first switching state, where the first or third contact terminals 23,33 are electrically connected to the second contact terminals 421 through the ball 5.

As illustrated, the switch of the present invention may be designed to be placed in a switch-on state (as shown in FIG. 5) or a switch-off state (as shown in FIG. 17) when mounted uprightly on a substrate.

Figure 20:
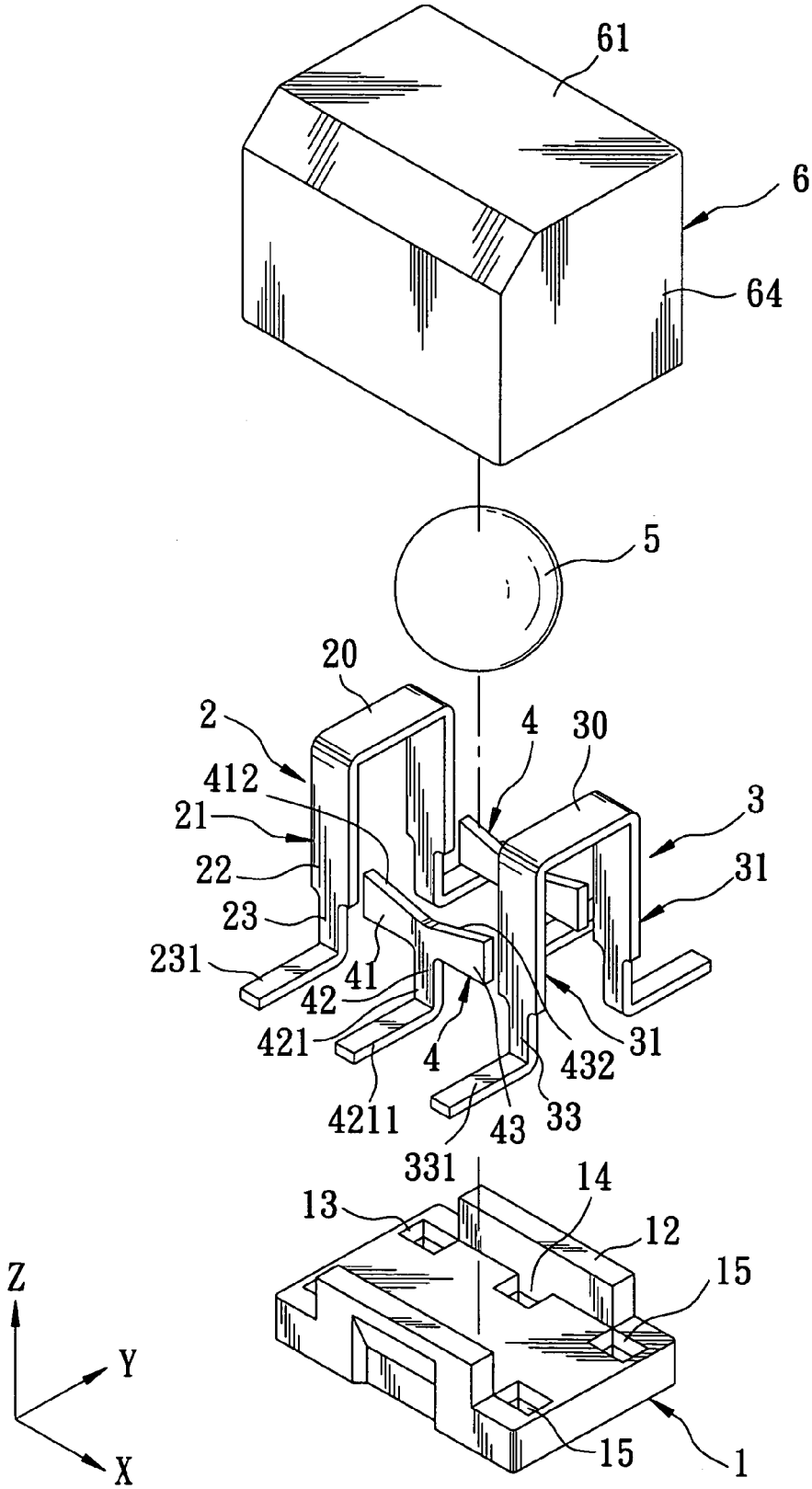
FIG. 20 is an exploded perspective view of the sixth preferred embodiment of a jerking-initiated switch according to this invention.

Referring to FIG. 20, the sixth preferred embodiment of a jerking-initiated switch according to this invention is shown to be similar to the fifth embodiment in construction. In the sixth embodiment, each of the first, second and third contact terminals 23,421,33 has a contact end 231,4211,331 which is bent to extend in the first transverse direction (Y) and which has a major surface that is adapted to be attached to the substrate using a conventional SMT process.

Figure 21:
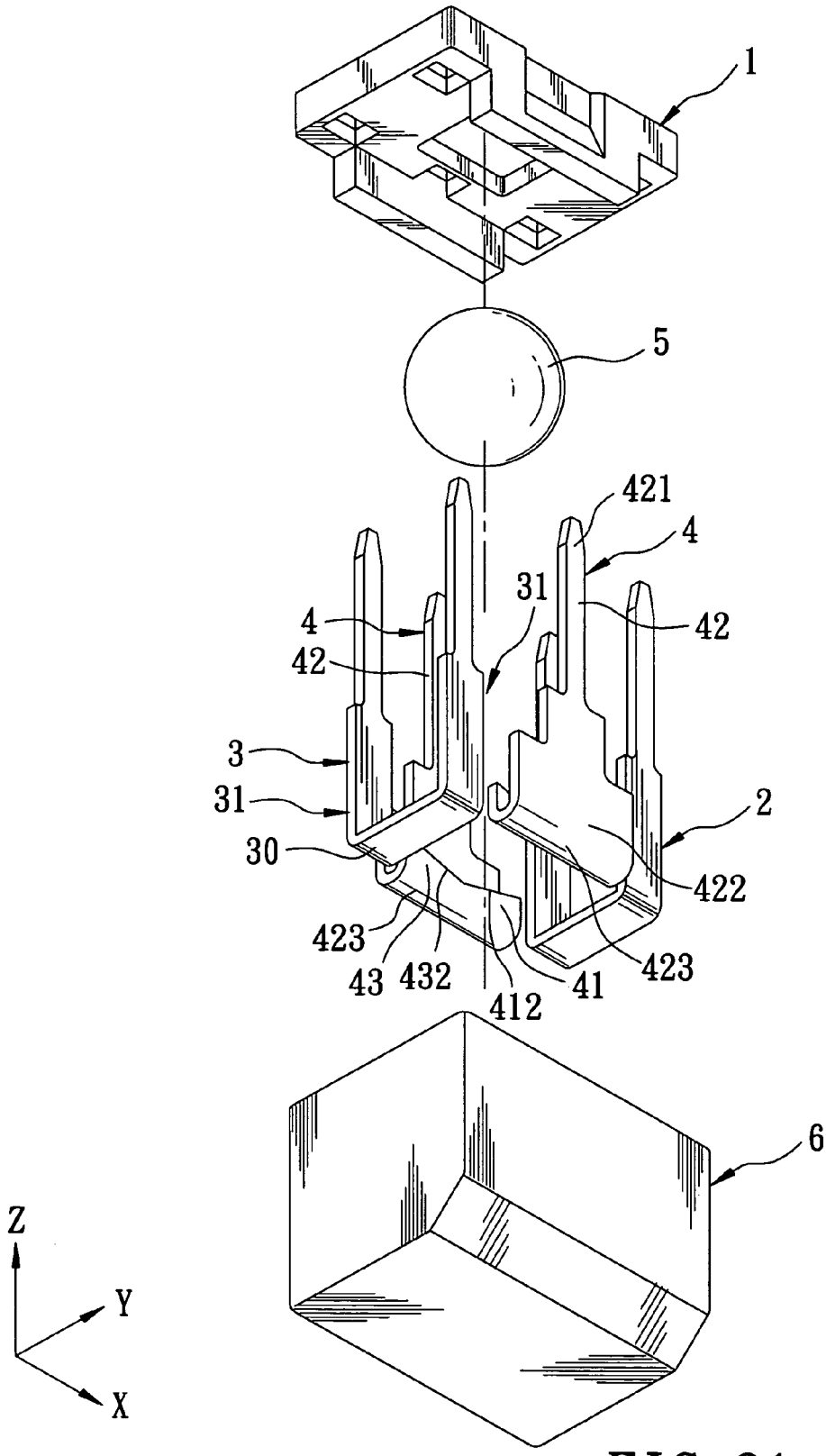
FIG. 21 is an exploded perspective view of the seventh preferred embodiment of a jerking-initiated switch according to this invention.
Figure 22:
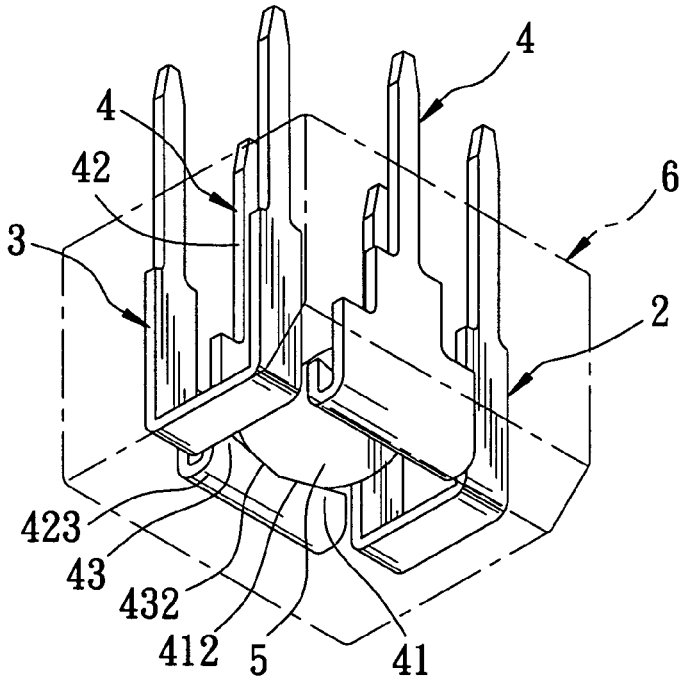
FIG. 22 is a schematic perspective view of the seventh preferred embodiment in a rest state.
Figure 23:
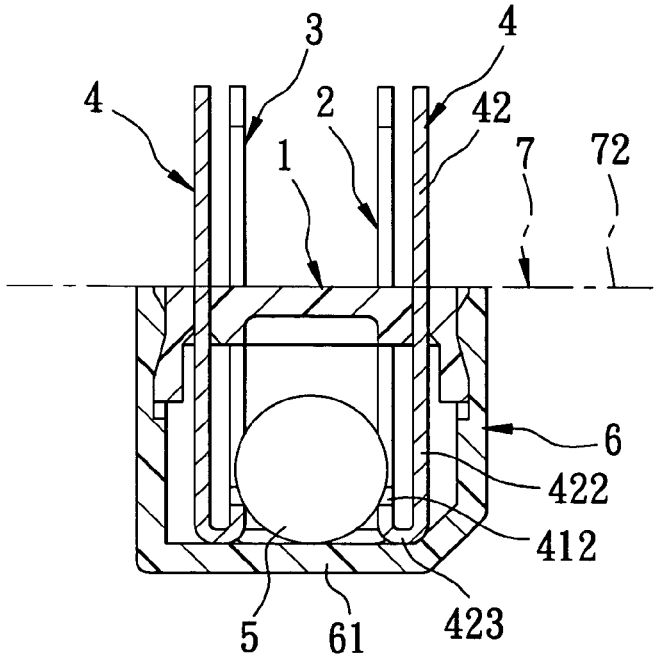
FIG. 23 is a cross-sectional view of the seventh preferred embodiment in the rest state of FIG. 22.

Referring to FIGS. 21 to 23, the seventh preferred embodiment of a jerking-initiated switch according to this invention is shown to be similar to the third embodiment in construction. In the seventh embodiment, the first and second limb members 41,43 have a configuration the same as that of the fifth preferred embodiment, and is adapted to be mounted on a lower surface 72 of a substrate 70.

Figure 24:
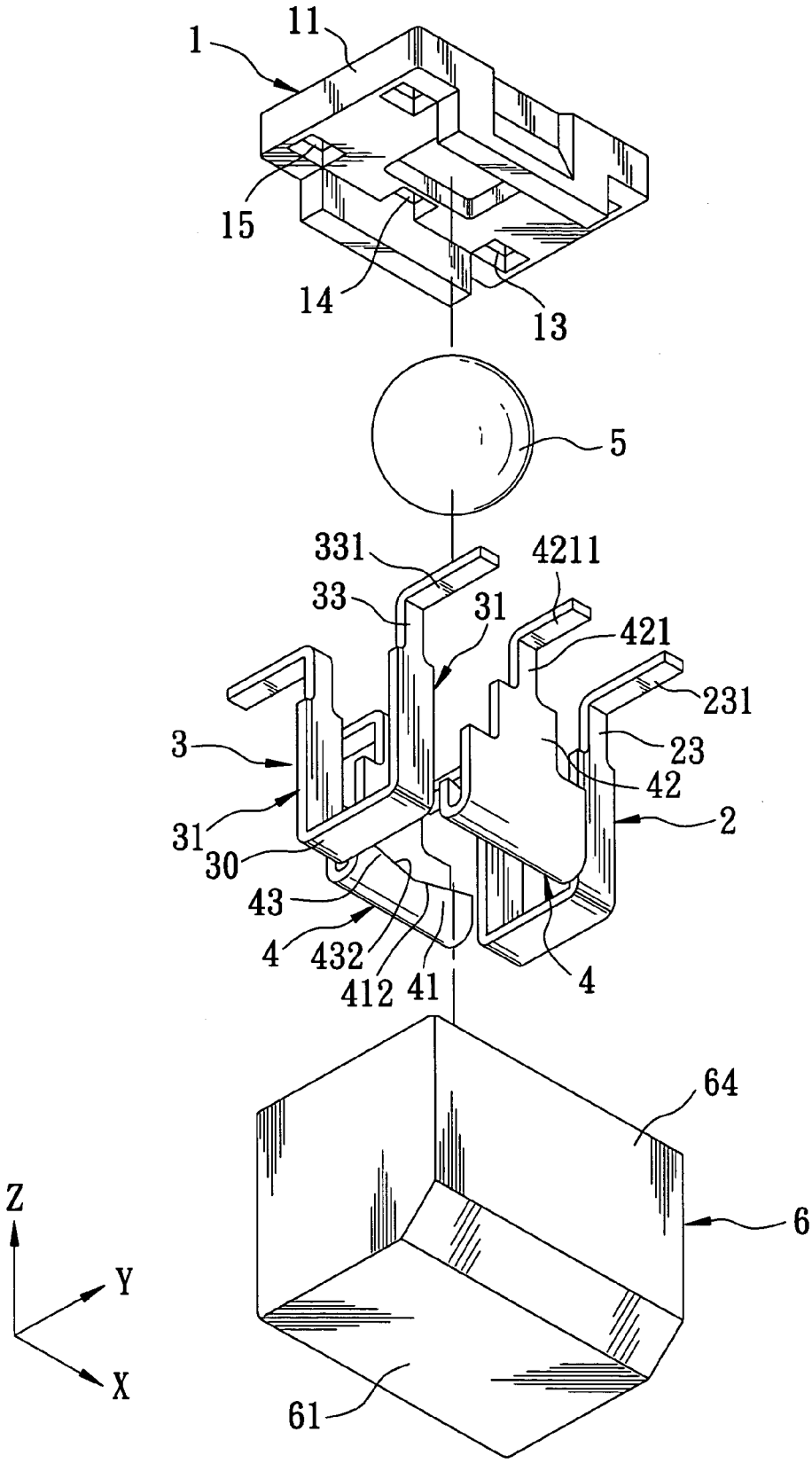
FIG. 24 is an exploded perspective view of the eighth preferred embodiment of a jerking-initiated switch according to this invention.

Referring to FIG. 24, the eighth preferred embodiment of a jerking-initiated switch according to this invention is shown to be similar to the seventh embodiment in construction. In the eighth embodiment, each of the first, second and third contact terminals 23,421,33 has a contact end 231, 4211,331 which is bent to extend in the first transverse direction (Y) and which has a major surface that is adapted to be attached to the substrate using a conventional SMT process.

Figure 25:
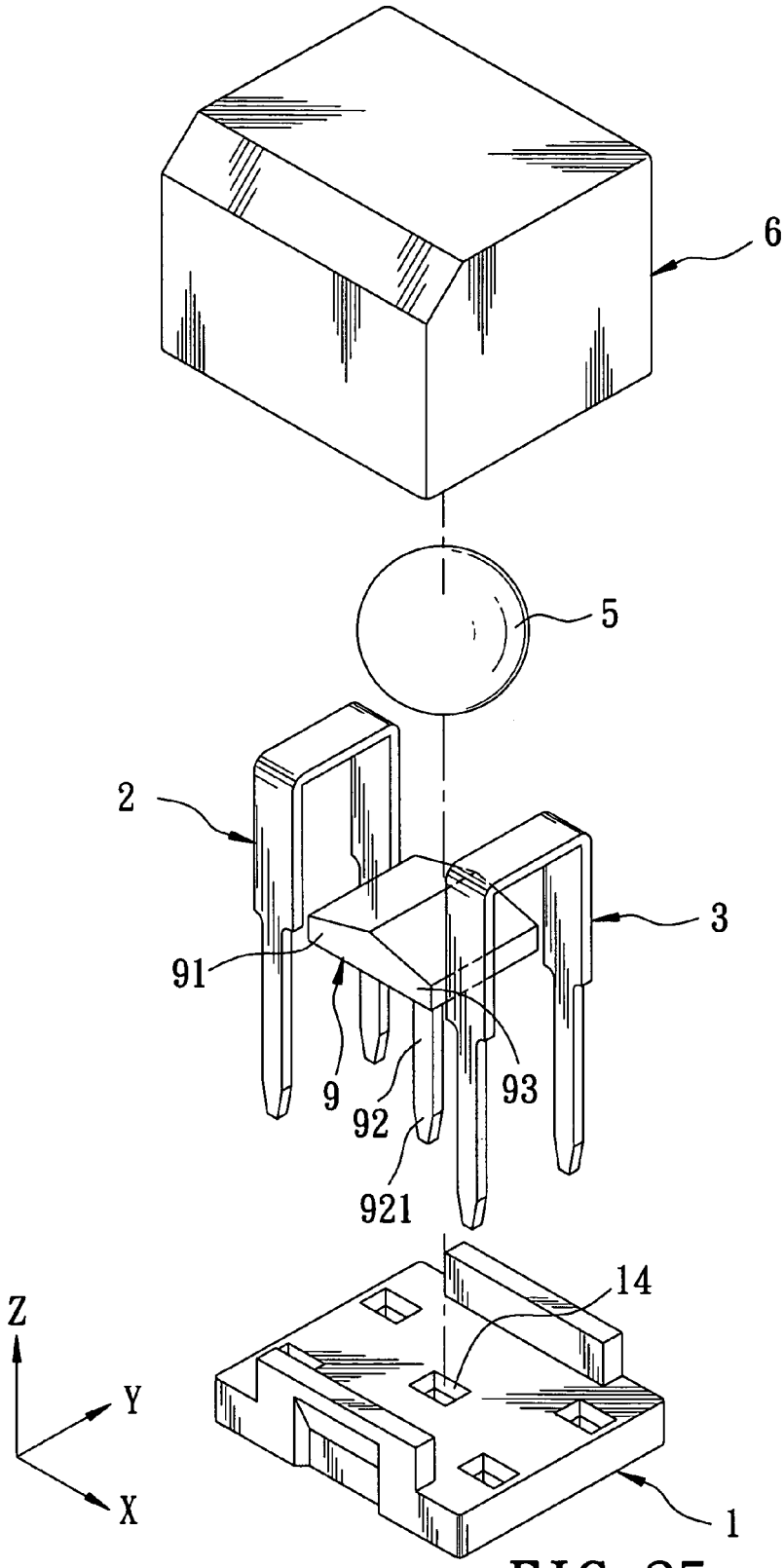
FIG. 25 is an exploded perspective view of the ninth preferred embodiment of a jerking-initiated switch according to this invention.

Referring to FIG. 25, the ninth preferred embodiment of a jerking-initiated switch according to this invention is shown to be similar to the first embodiment in construction. In the ninth embodiment, a second terminal unit 9 is provided. Specifically, the second terminal unit 9 is formed as a single-piece, and includes a shank member 92 which has the contact terminal 921 extending through a through hole 14 that is formed in a central region of the base wall 11 between the first and second lateral sides, and first and second limb members 91,93 which extend in the first transverse direction (Y) to confront respective ones of the first and third terminal units 2,3 in the longitudinal direction (X).

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A jerking-initiated switch mountable on and to be disposed in electric contact with a substrate, said jerking-initiated switch comprising:

an insulating frame which includes a base wall that has first and second lateral sides opposite to each other in a longitudinal direction, and front and rear sides opposite to each other in a first transverse direction transverse to the longitudinal direction, and first and second upright walls extending respectively from said first and second lateral sides in a second transverse direction transverse to both the first transverse direction and the longitudinal direction to define therebetween a rolling path;

an electrically conductive ball disposed to be rollable along said rolling path between first and second switching positions where said switch is in first and second switching states, respectively;

a first interconnecting member which is disposed adjacent to said first lateral side, and which extends in the first transverse direction to terminate at front and rear first joining ends;

front and rear first shank members which are made from an electrically conductive material, which are respectively connected to said front and rear first joining ends, and which extend in the second transverse direction to respectively terminate at front and rear first contact terminals that extend outwardly of said frame to electrically contact the substrate;

at least one second shank member which is made from an electrically conductive material, and which is secured to said base wall, said at least one second shank member being disposed to extend in the second transverse direction to terminate at a second contact terminal that extends outwardly of said frame to electrically contact the substrate, and at a second joint that is opposite to said second contact terminal; and at least one first limb member which is integrally formed with and which extends from said second joint in the longitudinal direction to form a first guideway along said rolling path such that said ball can slidably contact said at least one first limb member, and which extends towards said front and rear first shank members to terminate at a first threshold region, said first threshold region being spaced apart from said front and rear first shank members, and corresponding to the first switching position, said at least one first limb member having a first idle region which is configured to correspond to the second switching position such that once said ball is caused to displace from one of said first idle and threshold regions to the other of said first idle and threshold regions in response to a jerking action, said switch is placed in one of the first and second switching states.

2. The jerking-initiated switch of claim 1, wherein said first interconnecting member is in a form of a plate and is integrally formed with said front and rear first shank members.

3. The jerking-initiated switch of claim 2, further comprising:

a second interconnecting member which is disposed adjacent to said second lateral side such that front and rear second shank members are disposed between said first and second interconnecting members, and which extends in the first transverse direction to terminate at front and rear second joining ends;

front and rear third shank members which are made from an electrically conductive material, which are respectively connected to front and rear second joining ends, and which extend in the second transverse direction to respectively terminate at front and rear third contact terminals that extend outwardly of said frame to electrically contact the substrate; and at least one second limb member which is integrally formed with and which extends from a second joint in the longitudinal direction and away from said at least one first limb member so as to form a second guideway along said rolling path such that said ball can slidably contact said at least one second limb member, and which extends towards said front and rear third shank members to terminate at a second threshold region, said second threshold region being spaced apart from said front and rear third shank members, and corresponding to the first switching position, said at least one second limb member having a second idle region which is configured to correspond to the second switching position such that once said ball is caused to displace from one of said second idle and threshold regions to the other of said second idle and threshold regions in response to a jerking action, said switch is placed in one of the first and second switching states.

4. The jerking-initiated switch of claim 3, wherein said base wall has a pair of first through holes and a pair of third through holes formed therethrough in the second transverse direction for extension of said front and rear first contact terminals and said front and rear second contact terminals, respectively, and at least one second through hole formed therethrough for extension of said second contact terminal.

5. The jerking-initiated switch of claim 4, wherein each of said first and third shank members has a shoulder portion which is disposed to abut against said base wall when a respective one of said first and third contact terminals is extended through a corresponding one of said through holes.

6. The jerking-initiated switch of claim 3, wherein each of said first and second guideways is configured to descend from a respective one of said first and second idle regions to a respective one of said first and second threshold regions in the longitudinal direction such that said ball is rested on one of said first and second threshold regions to place said switch in the first switching state, where an electric connection between said first and second contact terminals or between said first and third contact terminals is established through said ball, and such that the jerking action causes said ball to displace from one of said first and second threshold regions to said first and second idle regions so as to place said switch in the second switching state, where the electric connections between said first and second contact terminals and between said third and second contact terminals are cut off.

7. The jerking-initiated switch of claim 3, wherein each of said first and second guideways is configured to ascend from a respective one of said first and second idle regions to a respective one of said first and second threshold regions in the longitudinal direction such that said ball is rested on said first and second idle regions to place said switch in the second switching state, where said first and third contact terminals are not electrically connected to said second contact terminals, and such that the jerking action causes said ball to displace from said first and second idle regions to one of said first and second threshold regions so as to place said switch in the first switching state, where said first or third contact terminals are electrically connected to said second contact terminals through said ball.

8. The jerking-initiated switch of claim 3, wherein said switch comprises two of said second shank members, which are secured to said front and rear sides, respectively, and which are spaced apart from each other in the first transverse direction such that said first limb members extend from said joints of said second shank members, respectively, said switch comprising two of said second limb members which respectively extend from said joints of said second shank members away from said first limb members.

9. The jerking-initiated switch of claim 8, wherein said second joint of each of said second shank members has a bent connecting portion which is bent to extend in the first transverse direction such that respective ones of said first and second limb members extend from said bent connecting portion in the second transverse direction.

10. The jerking-initiated switch of claim 3, wherein said at least one second shank member is secured to a middle region of said base wall between said first and second lateral sides, said first and second limb members being integrally formed with each other, each of said first and second limb members extending in the first transverse direction to confront respective ones of said first and third shank members in the longitudinal direction.

11. The jerking-initiated switch of claim 1, wherein each of said first and second contact terminals has a bent contact end which extends in the first transverse direction and which is abuttable against the substrate.

* * * * *